United States Patent [19]

Zipps et al.

[11] Patent Number: 4,798,519

[45] Date of Patent: Jan. 17, 1989

[54] COMPRESSOR PART SPAN SHROUD

[75] Inventors: Robert H. Zipps, East Hartford; Kent A. Lyons, East Haddam; Evans E. Griffin, Colchester, all of Conn.

[73] Assignee: United Technologies Corporation, Hartford, Conn.

[21] Appl. No.: 88,776

[22] Filed: Aug. 24, 1987

[51] Int. Cl.[4] ..... F01D 5/22

[52] U.S. Cl. ..... 416/191; 416/190; 416/196 R

[58] Field of Search ..... 416/190, 191, 196 R

[56] References Cited

U.S. PATENT DOCUMENTS

| | | | |
|---|---|---|---|
| 1,618,292 | 2/1922 | Meissner | 416/196 R |
| 2,278,040 | 3/1942 | Allen | 29/156.8 |
| 2,278,041 | 3/1942 | Allen . | |
| 2,366,142 | 12/1944 | Allen . | |
| 2,391,623 | 12/1945 | Heppner . | |
| 2,772,854 | 12/1956 | Anxionnaz | 416/190 |
| 3,104,093 | 9/1963 | Craig et al. | 416/190 |
| 3,216,699 | 11/1965 | Schoenborn | 416/190 |
| 3,396,905 | 8/1968 | Johnson . | |
| 3,477,795 | 11/1969 | Beesley | 416/191 |
| 3,545,882 | 12/1970 | Williamson | 416/190 |
| 3,572,970 | 3/1971 | Smuland | 416/221 |
| 3,708,244 | 1/1973 | Dawson et al. | 416/196 |
| 3,771,922 | 11/1973 | Tracy | 416/196 |
| 4,257,741 | 3/1981 | Betts | 416/190 |
| 4,257,742 | 3/1981 | Ogata et al. | 416/190 |

FOREIGN PATENT DOCUMENTS

| | | | |
|---|---|---|---|
| 3517283 | 11/1986 | Fed. Rep. of Germany | 416/196 R |
| 1314391 | 12/1962 | France . | |
| 1059222 | 12/1983 | U.S.S.R. | 416/191 |
| 1087675 | 4/1984 | U.S.S.R. | 416/190 |

*Primary Examiner*—Everette A. Powell, Jr.
*Attorney, Agent, or Firm*—Edward Kochey, Jr.

[57] ABSTRACT

A compressor blade assembly for a compressor operating at transonic or supersonic blade speeds has a part span shroud. The shroud is twisted having a first angle in the direction of airflow on one side of the shock wave and a second angle in the direction of airflow on the other side of the shock wave.

7 Claims, 2 Drawing Sheets

COMPRESSOR PART SPAN SHROUD

TECHNICAL FIELD

The invention relates to gas turbine compressors and in particular to a part span shroud for resisting vibration and twisting of compressor blades.

The blades of high speed turbo compressors are subject to flutter or vibration and axial torsion. Part span shrouds are therefore located in the order of three-quarters of the span of the blade and connected between adjacent blades. These shrouds have a discrete length in the direction of airflow so as to provide sufficient moment arm to resist twisting of the blades. These are frequently in two parts where such shrouds or fins from adjacent blades abut one another so as to resist vibration by frictional sliding between adjacent fins.

With the discrete axial length these shrouds form a portion of a cylinder, or in some cases a portion of a cone so that airflow passing thereover is less disturbed.

DISCLOSURE OF THE INVENTION

We have noted that with turbo compressors operating in the transonic or supersonic range the shock wave disturbs the flow pattern. The air behind the shock wave is compressed, and while it continues at the same radial velocity in passing through the compressor, its axial velocity is changed. Accordingly, portions of the part span shroud which are ideal for the flow field upstream of the shock wave are not optimum for the portion of the flow field downstream of the shock wave.

In accordance with our invention, the part span shrouds are formed of fins having an angle with respect to the axis of the rotor in the direction of airflow. A first or lesser angle exists in this fin in the area adjacent to the suction (convex) side of each blade which angle is of an amount substantially in accordance with the prior art. The portion of the fin adjacent to the pressure (concave) side has a greater angle. The change between the greater angle and the lesser angle occurs substantially at the location where the shock wave from the leading edge of each blade falls on the shroud. This is determined at a selected operating condition, which normally would be the cruise condition, at which time maximum efficiency is desired. This change in angle may be in the form of a gradual twist in the fins thereby maintaining a stiffer fin in compression than would be the case where there is an abrupt change in the fin twist.

BEST MODE FOR CARRYING OUT THE INVENTION

Figure 1:
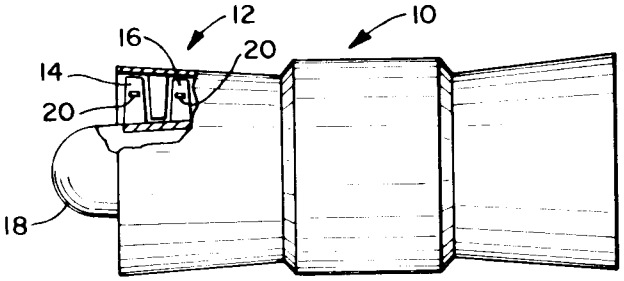
FIG. 1 is a general view of a compressor and gas turbine.

FIG. 1 shows a gas turbine engine 10 having an axial flow air compressor 12. This compressor includes rows of blades 14 and 16 mounted on compressor rotor shaft 18. Part span shrouds 20 are located about the three-quarter span point in each set of rotor blades.

Figure 2:
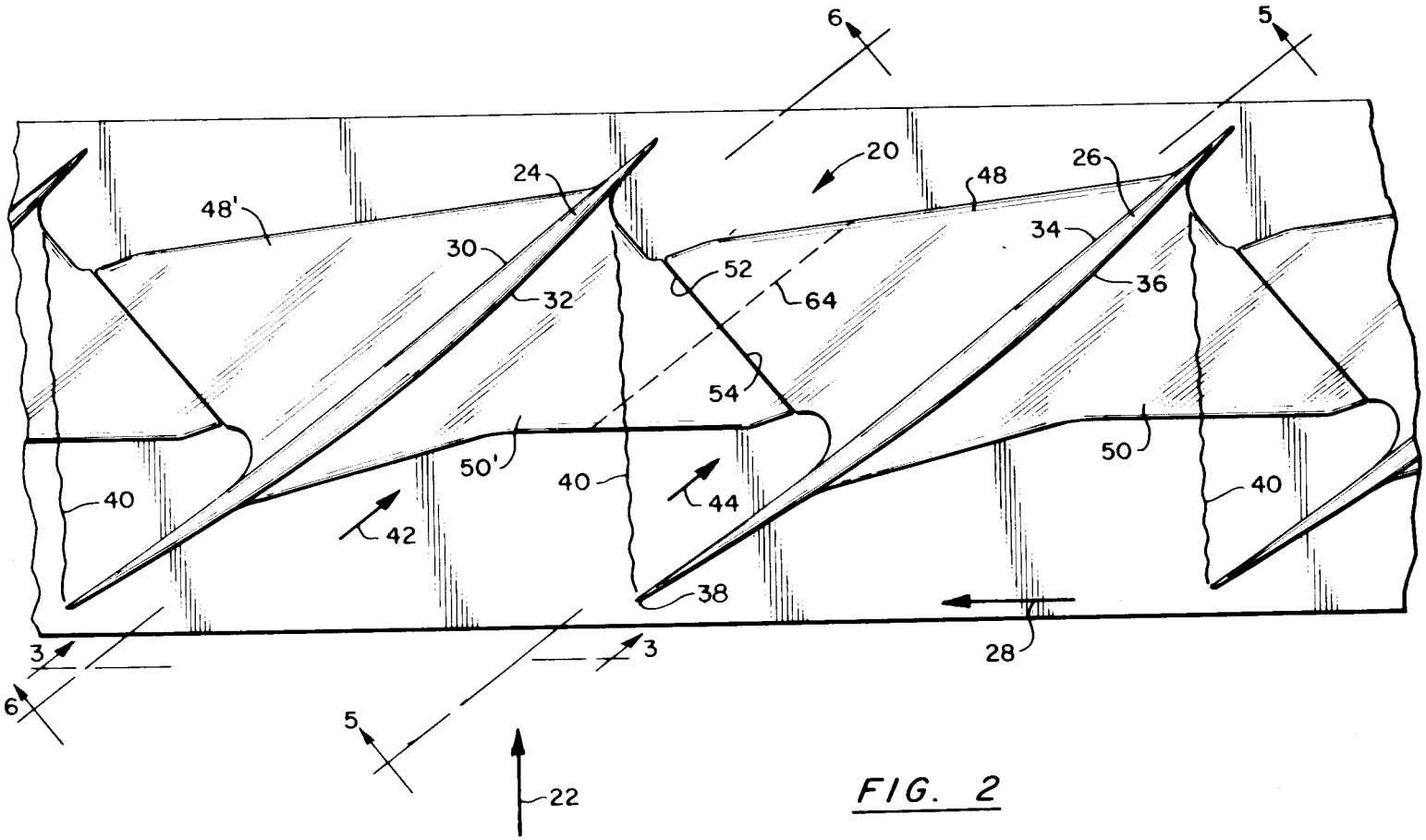
FIG. 2 is a plan view looking radially inward showing two compressor blades and the part span shrouds formed of fins.

Referring to FIG. 2 airflow passing as shown by arrow 22 enters through compressor blades 24 and 26 which are rotating in the direction shown by arrow 28. Blade 24 has a concave side 30 which is the pressure side surface and a convex side 32 which is the suction side surface. Similarly, blade 26 has a pressure side surface 34 and a suction side surface 36. The compressor is operating at high velocities where the leading edge 38 is at transonic or supersonic velocity resulting in a shock wave 40 passing downstream between the blades.

Airflow 22 passing between the blades has not only the axial component through the blades but a radial component as a result of the tapered flow path which can be seen from FIG. 1. This condition exists in the area shown by arrow 42. Beyond the shock wave 40 the flow indicated by arrow 44 also has an axial component and a radial component. The air, however, is compressed beyond the shock wave in this area. The compression is in the nature of an axial compression so that its radial component remains the same while the axial component is decreased because of the increased density of the air.

The shroud is formed by each blade such as 26 having a circumferentially extending fin 48 on the pressure side and the circumferentially extending fin 50 on the suction side. 48' and 50' represent these same fins as located on blade 24. An abutment surface 52 covered with hard facing material abuts against a similarly hard faced abutment surface 54 on fin 50'. As the blades 24 and 26 vibrate around their minor axis, such vibration is dampened by friction between surfaces 52 and 54.

Twisting or rotation of the blades around their longitudinal axis is resisted by a bending moment being transmitted through the inner face between surfaces 52 and 54 passing forces to the adjacent blades. The shrouds must pass not only the dynamic forces due to compressing the air but any shock loading caused by ingestion of foreign objects into the blades. Significant compressive loading can occur in these fins.

Figure 3:
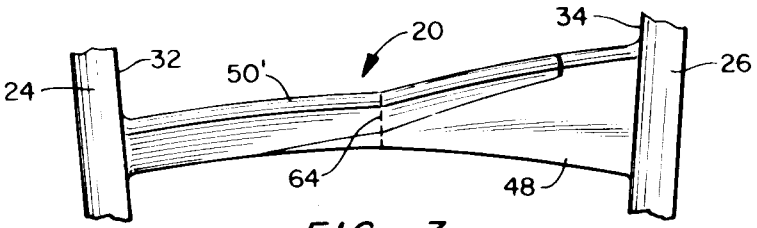
FIG. 3 is an elevation view of the fins looking in a direction generally parallel to the surface of the blades.
Figure 4:
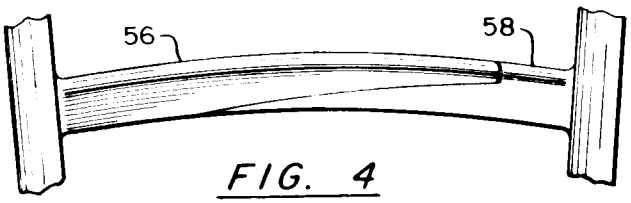
FIG. 4 PRIOR ART
FIG. 4 is a similar view showing the prior art structure.

FIG. 3 taken on section 3—3 of FIG. 2 looking at the edges of the fins is best compared to FIG. 4 which illustrates the prior art with such a view. All the angles of the blades with respect to the axis of the rotor shaft are exaggerated in these drawings for clarity in illustration. In FIG. 4 it can be seen that the prior art shrouds formed of fins 56 and 58 are substantially conical in shape to merge with the predicted airflow.

Figure 6:
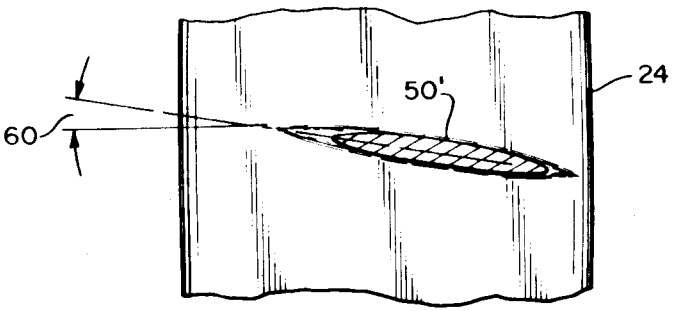
FIG. 6 is a sectional side view through the fin at a location near the suction surface of the blade.

FIG. 3 illustrates the present invention wherein the angle of the fin varies between the side towards the pressure surface of an adjacent blade and the side toward the suction surface of an adjacent blade. Since the fins are in line and abutting at surfaces 52 and 54 the construction of the fins can best be understood by ignoring this separation and treating the two components as a single area shroud. A portion of the fin near suction surface 32 has only a slight angle in the order of 1 to 3 degrees with respect to the axis of the rotor shaft. This is shown in FIG. 6 with the angle 60.

Figure 5:
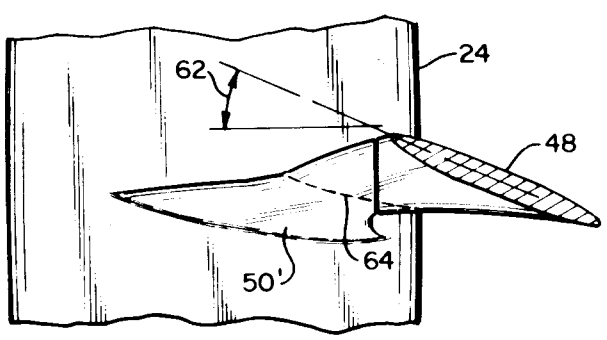
FIG. 5 is a sectional side view through the fin near the pressure side of the blade.

The portion of the fin adjacent to the pressure surface 34 has a steeper angle 62 as shown in FIG. 5 which is in the order of 3 to 9 degrees. Since the airflow 44 behind the shock wave 40, as shown in FIG. 2, has a smaller forward velocity with the same radial velocity it moves at an angle with respect to the axis of the rotor which is greater than the angle of the airflow outside the shock wave. The change in the angle of the fins therefore matches this airflow resulting in less pressure loss. As seen in FIGS. 5 and 6 this fin has a general streamline shape to further reduce the pressure loss.

It can be seen in FIG. 3 that a uniform twist in the fins occurs following the bend line 64, resulting in a gradually increasing angle in the fins. While a sudden transition to the new angle is acceptable and in accordance with the theory, the gradual twist provides the structural benefit of better sustaining axial loads through the fin while still approximating the desired airflow requirements. It also is easier to fabricate than other more complex shapes.

In effecting this gradual twist there is a fin axis around which the fin twists. Locating this axis near the center of the fin reduces the maximum offset of one edge of the fin from the other. This also results in a stiffer blade under compressive loading.

While the compressor described is of the type where the outer diameter of succeeding rows of rotor blades decreases and the compressed air moves radially toward the shaft, the invention has application to other designs. Where the outside diameter of the blades of succeeding rows substantially the same but the radius of the root of the blades increases, the pattern is reversed in that the flow is outward toward the circumference. The same concept of change of angles occurs although it is reversed in that the diameter of the fins would increase in the direction of airflow rather than decrease as described above.

We claim:

1. A compressor blade assembly for compressors operating at transonic or supersonic blade speeds comprising:

a rotor shaft;

a plurality of circumferentially spaced coplanar airfoil blades mounted on said shaft, each having a pressure surface side and a suction surface side;

an intermediate part span shroud for resisting twisting and for damping vibration of said blades;

said shroud comprising a circumferentially extending fin on each of each blade, the fins of adjacent blades in abutting relationship;

said fins of elongated streamlined shape and extending at an angle with the axis of said rotor shaft in the direction of airflow; and said fins having a greater angle toward the pressure surface side of each blade and a lesser angle toward the suction surface side of each blade.

2. A compressor blade assembly as in claim 1:

the change between said greater angle and said lesser angle occurring substantially at a location where the shock wave from the leading edge of each of said blades falls on said shroud at a predetermined operating condition.

3. A compressor blade assembly as in claim 2:

said predetermined operating condition being cruise design condition.

4. A compressor blade assembly as in claim 1:

said compressor being of the type where the outside diameter of the blades decreases in the direction of airflow; and said fins extending at an angle having a decreasing radius in the direction of airflow.

5. A compressor blade assembly as in claim 1:

said fins having a gradual transition from said lesser angle to said greater angle.

6. A compressor blade assembly as in claim 5:

an axis in said fins about which the twisting occurs being located at approximately the center of said fins.

7. A compressor blade assembly as in claim 1:

said lesser angle being between 1 and 3 degrees, and said greater angle being a multiple of 2 to 3 times said lesser angle.

* * * * *